US008842059B2

(12) United States Patent
Wang et al.

(10) Patent No.: US 8,842,059 B2
(45) **Date of Patent: *Sep. 23, 2014**

(54) DISPLAY SYSTEM

(75) Inventors: Shou-Cheng Wang, Miao-Li County (TW); Tse-Yuan Chen, Miao-Li County (TW); Du-Zen Peng, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 121 days.

This patent is subject to a terminal disclaimer.

(21) Appl. No.: 13/552,073

(22) Filed: Jul. 18, 2012

(65) Prior Publication Data

US 2013/0027380 A1 Jan. 31, 2013

(30) Foreign Application Priority Data

Jul. 29, 2011 (TW) ..... 100126939 A

(51) Int. Cl.
*G09G 3/30* (2006.01)

(52) U.S. Cl.
USPC ..... 345/76; 345/77; 345/89; 345/690; 315/169.1; 315/169.3

(58) Field of Classification Search
USPC ..... 345/76–83, 211–213, 690; 315/169.1–169.3
See application file for complete search history.

(56) References Cited

U.S. PATENT DOCUMENTS

| | | | | |
|---|---|---|---|---|
| 8,111,216 | B2 * | 2/2012 | Chan et al. | 345/76 |
| 2005/0067970 | A1 | 3/2005 | Libsch et al. | |
| 2005/0237281 | A1 * | 10/2005 | Tam | 345/76 |
| 2007/0195020 | A1 | 8/2007 | Nathan et al. | |
| 2008/0030437 | A1 | 2/2008 | Iida et al. | |
| 2010/0156762 | A1 | 6/2010 | Choi | |
| 2012/0299896 | A1 * | 11/2012 | Peng et al. | 345/211 |

OTHER PUBLICATIONS

Taiwanese language office action dated Jan. 20, 2014.

* cited by examiner

*Primary Examiner* — Jennifer Nguyen
(74) *Attorney, Agent, or Firm* — McClure, Qualey & Rodack, LLP

(57) ABSTRACT

A display system including at least one pixel is disclosed. The pixel includes a switching unit and a controlling unit. The switching unit controls a level of a first node. The controlling unit controls a level of a second node. During a first period, the level of the first node equals to a first reference level and the level of the second node equals to a second reference level. During a second period, the level of the first node equals to a third reference level and the voltage difference between the first and the second nodes equals to a threshold voltage of a driving unit. During a third period, the level of the first node equals to a data signal. During a fourth period, the driving unit lights a luminescence unit according to the voltage difference between the first and the second nodes.

11 Claims, 8 Drawing Sheets

| Period | Level |
| --- | --- |
| st1 | $N_{G1} = S_{REF1}$<br>$N_{S1} = S_{REF2}$ |
| st2 | $N_{G1} = S_{REF3}$<br>$N_{S1} = -V_{th(M3)}$ |
| st3 | $N_{G1} = S_{DATA}$<br>$N_{S1} = -V_{th(M3)} + \Delta V$ |
| st4 | $N_{G1} = S_{DATA} + V_OLED$<br>$N_{S1} = -V_{th(M3)} + \Delta V + V_OLED$ |

FIG. 2C

| Period | Level |
|---|---|
| st1 | $N_{G2} = S_{REF1}$<br>$N_{S2} = S_{REF2}$ |
| st2 | $N_{G2} = S_{REF3}$<br>$N_{S2} = -V_{th(M3)}$ |
| st3 | $N_{G2} = S_{DATA}$<br>$N_{S2} = -V_{th(M3)} + \Delta V$ |
| st4 | $N_{G2} = S_{DATA} + V_OLED$<br>$N_{S2} = -V_{th(M3)} + \Delta V + V_OLED$ |

FIG. 3C

DISPLAY SYSTEM

CROSS REFERENCE TO RELATED APPLICATIONS

This Application claims priority of Taiwan Patent Application No. 100126939, filed on Jul. 29, 2011, the entirety of which is incorporated by reference herein.

BACKGROUND OF THE INVENTION

1. Field of the Invention

The invention relates to a display system, and more particularly to a display system, which can compensate a threshold voltage of a driving transistor.

2. Description of the Related Art

Because cathode ray tubes (CRTs) are inexpensive and provide high definition, they are utilized extensively in televisions and computers. With technological development, new flat-panel displays have continually been developed. When a larger display panel is required, the weight of the flat-panel display does not substantially change when compared to CRT displays.

Generally, the display panel of the flat-panel display comprises a plurality of pixels. Each pixel comprises a driving transistor and a luminescence element. The driving transistor generates a driving current according to an image signal. The luminescence element displays a corresponding brightness according to the driving current.

However, the driving transistors of the different pixels may comprise different threshold voltages due to manufacturing procedures. When the driving transistors with different threshold voltages receive the same image signal, the driving transistors may generate different driving currents such that the luminescence elements display different brightness.

Additionally, the operation voltage of the luminescence element is drifted because the luminescence element is used for long time. The different luminescence elements may display different brightness when the luminescence elements receive the same driving current. For example, assuming two luminescence elements comprise different operation voltage. If the two luminescence elements receive the same driving current, the brightness of the two luminescence elements are different.

BRIEF SUMMARY OF THE INVENTION

In accordance with an embodiment, a display system comprises a scan driver, a data driver, and at least one pixel. The scan driver provides at least one scan signal. The data driver provides at least one data signal. The pixel comprises a switching unit, a driving unit, a luminescence unit, a storage unit and a controlling unit. The switching unit controls a level of a first node according to the scan signal. The driving unit has a threshold voltage and is coupled to the first node. The luminescence unit is coupled to the driving unit in series between a first operation voltage and a second operation voltage. The storage unit is coupled between the first node and a second node. The controlling unit controls a level of the second node. During a first period, the level of the first node is equal to a first reference level, and the level of the second node is equal to a second reference level. During a second period, the level of the first node is equal to a third reference level, and the controlling unit makes a voltage difference between the levels of the first and the second nodes to be equal to the threshold voltage of the driving unit. During a third period, the level of the first node is equal to the data signal.

During a fourth period, the driving unit lights the luminescence unit according to the voltage difference between the levels of the first and the second nodes.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein:

FIG. 2C shows the levels of nodes $N_{G1}$ and $N_{S1}$ during different periods;

FIG. 3C shows the levels of the nodes $N_{G2}$ and $N_{S2}$ during different periods.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
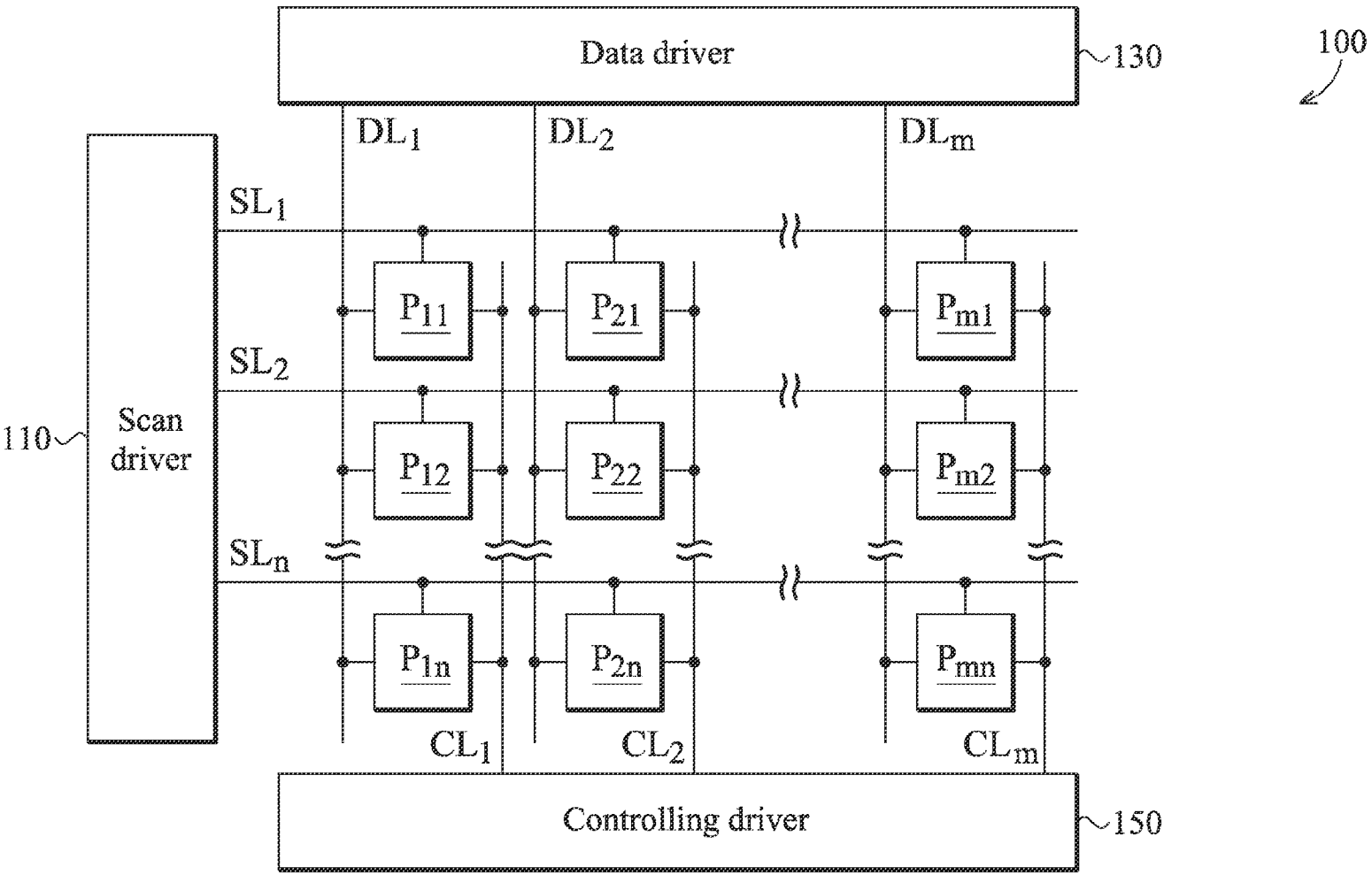
FIG. 1 is a schematic diagram of an exemplary embodiment of a display system.

FIG. 1 is a schematic diagram of an exemplary embodiment of a display system. The display system 100 comprises a scan driver 110, a data driver 130, a controlling driver 150 and pixels $P_{11}$~$P_{mn}$. The scan driver 110 provides scan signals to the pixels $P_{11}$~$P_{mn}$ via scan lines $SL_1$~$SL_n$. The data driver 130 provides data signals to the pixels $P_{11}$~$P_{mn}$ via data lines $DL_1$~$DL_m$. The controlling driver 150 provides control signals to the pixels $P_{11}$~$P_{mn}$ via control lines $CL_1$~$CL_m$.

In one embodiment, the data driver 130 provides not only the data signals but also reference levels to the pixels $P_{11}$~$P_{mn}$. In another embodiment, the reference levels are provided from the controlling driver 150 or other circuits. In this case, the controlling driver 150 is capable of providing the reference levels to the pixels $P_{11}$~$P_{mn}$ via the data lines $DL_1$~$DL_m$, but the disclosure is not limited thereto. In other embodiments, the controlling driver 150 provides the reference levels to the pixels $P_{11}$~$P_{mn}$ via other control lines (not shown).

Additionally, the controlling driver 150 further provides other control signals to the scan driver 110 and/or the data driver 130. For example, the controlling driver 150 is a timing controller, but the disclosure is not limited thereto. Furthermore, the controlling driver 150 can be integrated into the scan driver 110 or the data driver 130.

The invention does not limit the method of providing the control signal to the pixels $P_{11}$~$P_{mn}$. In one embodiment, the controlling driver 150 utilizes a single control line to provide one control signal to the pixels in the same column (vertical direction). For example, the controlling driver 150 utilizes the control line $CL_1$ to transmit a control signal to the pixels $P_{11}$, $P_{12}, \ldots, P_{1n}$ arranged into a first column. In other embodiments, the controlling driver 150 utilizes different control lines to provide different control signals to the pixels in the same column.

Figure 2A:
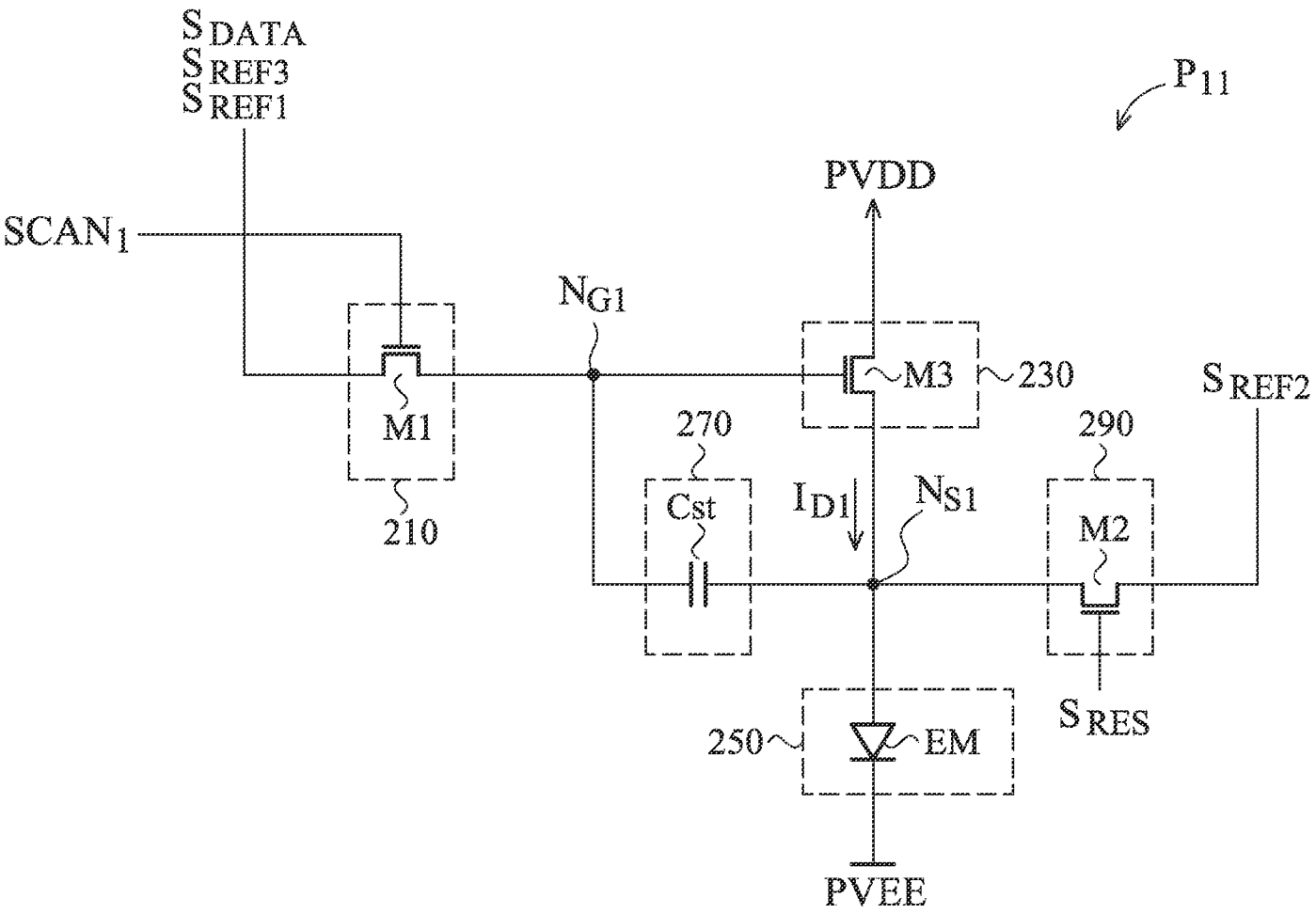
FIG. 2A is a schematic diagram of an exemplary embodiment of a pixel.

FIG. 2A is a schematic diagram of an exemplary embodiment of the pixel $P_{11}$. Since the structures of the pixels $P_{11}$~$P_{mn}$ are the same, only the pixel $P_{11}$ is given as an example. As shown in FIG. 2A, the pixel $P_{11}$ comprises a switching unit 210, a driving unit 230, a luminescence unit 250, a storage unit 270 and a controlling unit 290.

The switching unit 210 controls the level of the node $N_{G1}$ according to the scan signal $SCAN_1$ of the scan line $SL_1$. In this embodiment, the switching unit 210 transmits the signal of the data line $DL_1$ to the node $N_{G1}$ according to the scan signal $SCAN_1$. During different periods, the data line $DL_1$ transmits different signals, such as reference levels $S_{REF1}$, $S_{REF3}$ or a data signal $S_{DATA}$. Additionally, the invention does not limit the kinds of the switching unit 210. In this embodiment, the switching unit 210 is a N-type transistor M1, but the disclosure is not limited thereto.

The luminescence unit 250 is coupled to the driving unit 230 in series between operation voltages PVDD and PVEE. The luminescence unit 250 is lighted according to a driving current $I_{D1}$ generated by the driving unit 230. The invention does not limit the kinds of the luminescence unit 250. In this embodiment, the luminescence unit 250 is an organic light emitting diode (OLED) EM.

The driving unit 230 has a threshold voltage ($Vth_{(M3)}$) and is coupled to the node $N_{G1}$. The invention does not limit the kinds of the driving unit 230. In this embodiment, the driving unit 230 is a N-type transistor M3, but the disclosure is not limited thereto. The transistor M3 comprises a gate coupled to the node $N_{G1}$, a drain receiving the operation voltage PVDD and a source coupled to the node $N_{S1}$.

The storage unit 270 is coupled between the nodes $N_{G1}$ and $N_{S1}$. The invention does not limited to the kind of the storage unit 270. Any device can serve as the storage unit 270, as long as is capable of storing charges. In this embodiment, the storage unit 270 is a capacitor Cst.

The controlling unit 290 controls the level of the node $N_{S1}$. In one embodiment, the controlling unit 290 is a transistor M2. Since the transistor M2 is a N-type transistor, the gate of the transistor M2 can be referred to as a control terminal, the drain of the transistor M2 can be referred to as an input terminal, and the source of the transistor M2 can be referred to as an output terminal. In this embodiment, the control terminal of the transistor M2 receives a reset signal $S_{RES}$, the input terminal of the transistor M2 receives the reference level $S_{REF2}$, and the output terminal of the transistor M2 is coupled to the node $N_{S1}$.

The invention does not limit which device provides the reset signal $S_{RES}$ and the reference level $S_{REF2}$. In one embodiment, the reset signal $S_{RES}$ is provided by a signal generator, such as the scan driver 110, the data driver 130, the controlling driver 150, or other circuits. The reference level $S_{REF2}$ is provided by a level generator, such as the scan driver 110, the data driver 130, the controlling driver 150 or other circuits. In another embodiment, the reset signal $S_{RES}$ and the reference level $S_{REF2}$ are provided by the same device.

Figure 2B:
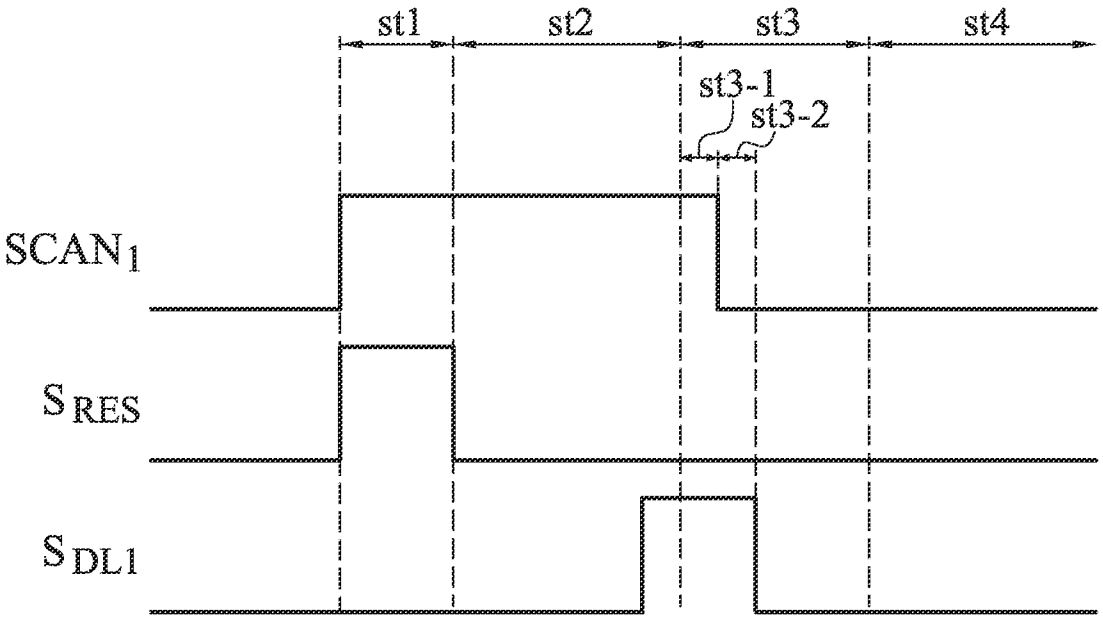
FIG. 2B is a schematic diagram of an exemplary embodiment of a scan signal $SCAN_1$, a reset signal $S_{RES}$ and a level of a data line $DL_1$.

FIG. 2B is a schematic diagram of an exemplary embodiment of the scan signal $SCAN_1$, the reset signal $S_{RES}$ and the level of the data line $DL_1$. Referring to FIG. 2B, the symbol $S_{DL1}$ represents the level of the data line $DL_1$. FIG. 2C shows the levels of the nodes $N_{G1}$ and $N_{S1}$ during different periods. Referring to FIG. 2A, during the period st1, the scan signal $SCAN_1$ is at a high level such that the transistor M1 is turned on. When the transistor M1 is turned on, the reference level $S_{REF1}$ is transmitted to the node $N_{G1}$. During this period, the transistor M2 is turned on because the reset signal $S_{RES}$ is at a high level. Thus, the reference level $S_{REF2}$ is transmitted to the node $N_{S1}$. As shown in FIG. 2C, the level of the node $N_{G1}$ is equal to the reference level $S_{REF1}$ and the level of the node $N_{S1}$ is equal to the reference level $S_{REF2}$ during the period st1.

The invention does not limit the proportion of the reference levels $S_{REF1}$ and $S_{REF2}$. In one embodiment, the reference level $S_{REF1}$ is higher than the reference level $S_{REF2}$. In this embodiment, the reference level $S_{REF1}$ is at a low level. In other embodiments, the reference level $S_{REF2}$ is equal to or higher than the operation voltage PVEE. The operation voltage PVEE is a negative voltage.

During the period st2, the scan signal $SCAN_1$ is still at the high level such that the transistor M1 is still turned on. Thus, the transistor M1 transmits the reference level $S_{REF3}$ to the node $N_{G1}$. In one embodiment, the reference level $S_{REF3}$ is at a low level. Referring to FIG. 2B, the level of the data line $DL_1$ is at a low level during the periods st1 and st2.

At this time, since the reset signal $S_{RES}$ is at a low level, the transistor M2 is turned off. Thus, a voltage difference between the nodes $N_{G1}$ and $N_{S1}$ is equal to the threshold voltage $Vth_{(M3)}$. In other words, the capacitor Cst stores the threshold voltage $Vth_{(M3)}$ of the transistor M3. Referring to FIG. 2C, the level of the node $N_{G1}$ is equal to the reference level $S_{REF3}$ and the level of the node $N_{S1}$ is equal to $-Vth_{(M3)}$ during the period st2.

The period st3 comprises a forward portion st3-1 and a back portion st3-2. During the forward portion st3-1, the scan signal $SCAN_1$ is still at the high level. At this time, the data line $DL_1$ transmits the data signal $S_{DATA}$. Thus, the level or the node $N_{G1}$ is equal to the data signal $S_{DATA}$. When the level of the node $N_{G1}$ is equal to the data signal $S_{DATA}$, the level of the node $N_{S1}$ is slightly increased. Assuming the level of the node $N_{S1}$ is $-Vth_{(M3)}+\Delta V$.

During the back portion st3-2, the scan signal SCAM is at a low level to turn off the transistor M1. Thus, the transistor M1 stops transmitting the signal of the data line $DL_1$ to the node $N_{G1}$. In other embodiments, the level of the node $N_{G1}$ does not be increased. Referring to FIG. 2C, the level of the node $N_{S1}$ is $-Vth_{(M3)}+\Delta V$, wherein $\Delta V$ is the change amount of the node $N_{S1}$ during the period st3.

In this embodiment, a self-feedback loop is formed by the capacitor Cst and the duration of the forward portion st3-1 is controlled. Thus, the level of the node $N_{S1}$ can be appropriately controlled according to the level of the node $N_{G1}$. In one embodiment, the level of the node $N_{S1}$ is set to less than a pre-determined value to prevent wrongfully turn on the luminescence unit 250.

During the period st4, the scan signal $SCAN_1$ is at the low level such that the state of the node $N_{G1}$ is at a floating state. At this time, the transistor M3 is still turned on. Finally, the level of the node $N_{S1}$ is equal to $-Vth_{(M3)}+\Delta V+V_OLED$. In one embodiment, V_OLED is a voltage difference of the OLED EM when the OLED EM is lighted. In other embodiments, V_OLED is an operation voltage of the OLED EM. It is required to determine whether a minimum value of the operation voltage of the OLED EM is equal to a threshold voltage of the OLED EM. Since the state of the node $N_{G1}$ is at a floating state, the level of the node $N_{G1}$ is equal to $S_{DATA}$+V_OLED. At this time, the transistor M3 generates a driving current $I_{D1}$ according to the voltage difference between the nodes $N_{G1}$ and $N_{S1}$. The luminescence unit 250 is lighted according to the driving current $I_{D1}$. The driving current $I_{D1}$ is expressed by the following equation:

$$I_{D1}=Kp*(Vgs-V_t)^2$$

If the levels of the nodes $N_{G1}$ and $N_{S1}$ during the period st4 are substituted with the above equation, the substituted result is expressed by the following equation:

$$I_{D1}=Kp*(S_{DATA}-\Delta V)^2$$

According to the above equation, the driving current $I_{D1}$ does not be interfered by the threshold voltage $Vth_{(M3)}$ of the transistor M3. Thus, a drift issue of the threshold voltage $Vth_{(M3)}$ can be compensated.

Furthermore, the levels of the nodes $N_{G1}$ and $N_{s1}$ relates to the voltage difference of the OLED EM during the period st4. Thus, the driving current $I_{D1}$ can compensate a drifted operation voltage of the OLED EM.

Figure 3A:
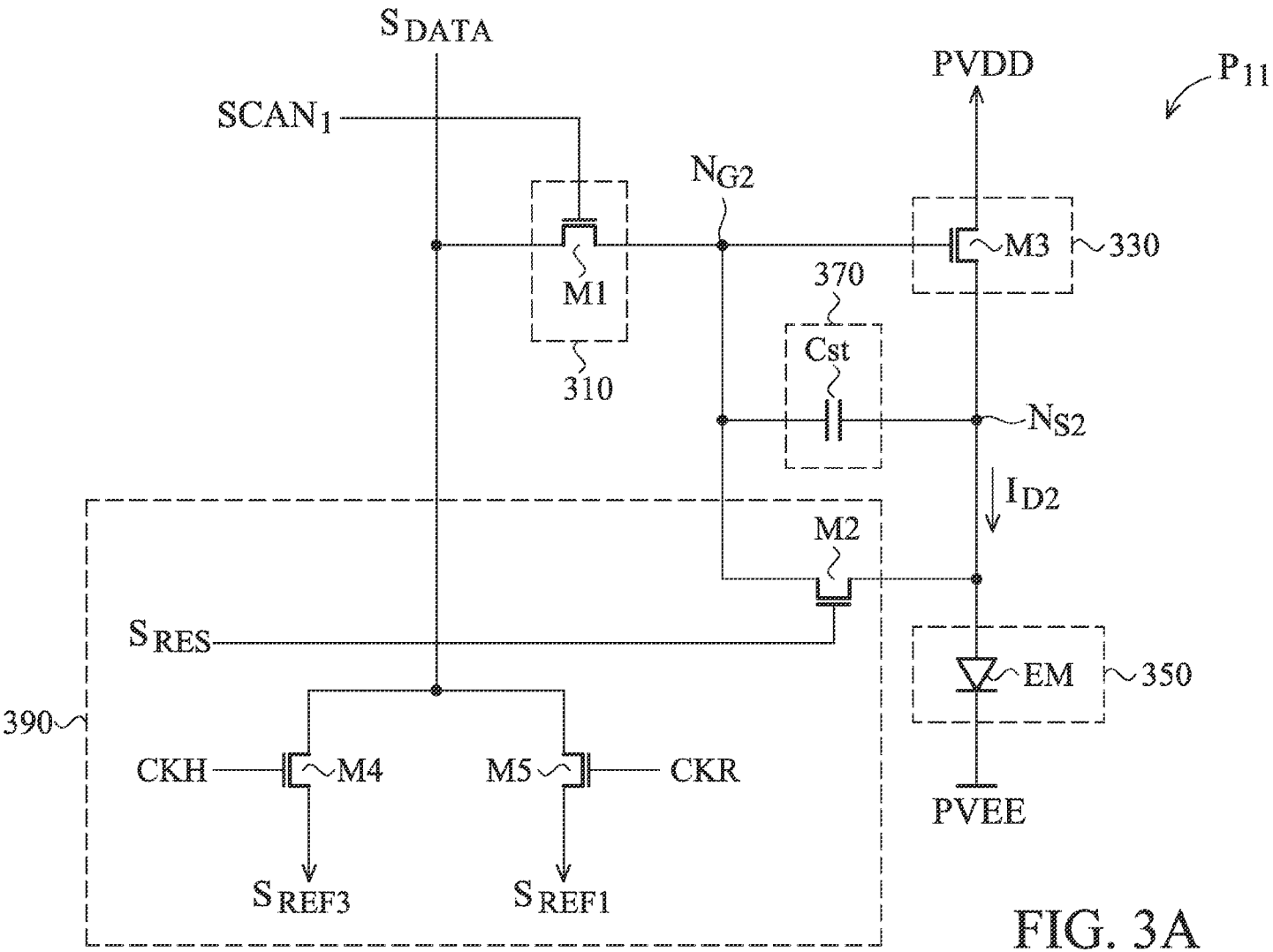
FIG. 3A is a schematic diagram of an exemplary embodiment of a pixel.

FIG. 3A is a schematic diagram of an exemplary embodiment of the pixel $P_{11}$. FIG. 3A is similar to FIG. 2A except for the controlling unit 390. Since operations of the switching unit 310, the driving unit 330 and the luminescence unit 350 and the storage unit 370 are the same as operations of the switching unit 210, the driving unit 230 and the luminescence unit 250 and the storage unit 270, the descriptions of the switching unit 310, the driving unit 330 and the luminescence unit 350 and the storage unit 370 are omitted for brevity.

In this embodiment, the controlling unit 390 is coupled not only to the node $N_{S2}$ but also to the node $N_{G2}$. As shown in FIG. 3A, the controlling unit 390 comprises transistor M2, M4 and M5. The transistor M2 is turned on according to the reset signal $S_{RES}$ such that the level of the node $N_{G2}$ is equal to the level of the node $N_{S2}$. The transistor M4 transmits the reference level $S_{REF3}$ to the switching unit 310 according to a control signal CKH. The transistor M5 transmits the reference level $S_{REF1}$ to the switching unit 310 according to a control signal CKR. The switching unit 310 transmits one of the reference levels $S_{REF1}$, $S_{REF3}$ and the data signal $S_{DATA}$ to the node $N_{G2}$ according to the scan signal $SCAN_1$ to control the level of the node $N_{G2}$.

Figure 3B:
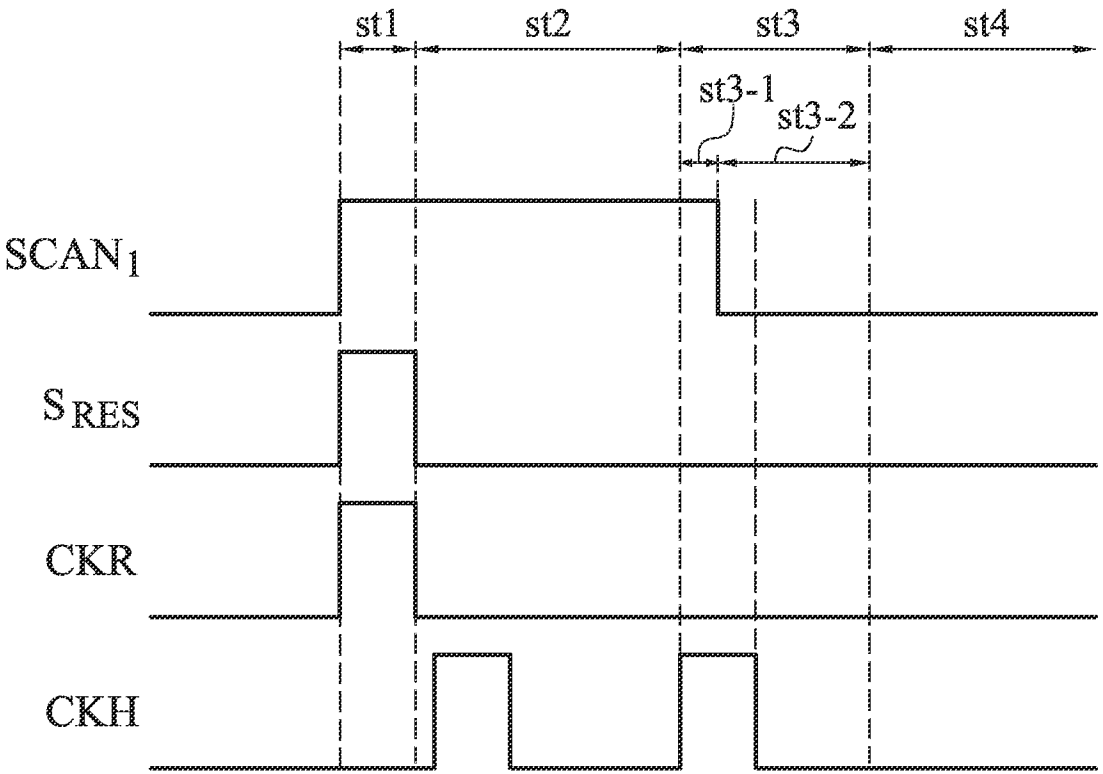
FIG. 3B is a timing control diagram of the pixel shown in FIG. 3A.

FIG. 3B is a timing control diagram of the pixel shown in FIG. 3A. FIG. 3C shows the levels of the nodes $N_{G2}$ and $N_{S2}$ during different periods. During the period st1, the scan signal $SCAN_1$ is at a high level to turn on the switching unit 310. At this time, the reset signal $S_{RES}$ is at a high level such that the transistor M2 is turned on. The control signal CKR is at a high level such that the transistor M5 is turned on. Since the transistor M2 is turned on, the level of each of the nodes $N_{G2}$ and the $N_{S1}$ is equal to the reference level $S_{REF1}$.

In one embodiment, the reference level $S_{REF1}$ is generated by a level generator, such as the data driver 130 or the controlling driver 150. The invention does not limit the magnitude of the reference level $S_{REF1}$. The reference level $S_{REF1}$ can be equal to or higher than the operation voltage PVEE. In this embodiment, the operation voltage PVEE is a negative voltage.

During the period st2, the scan signal $SCAN_1$ is at the high level such that the switching unit 310 is turned on. Since the control signal CKH is at a high level, the switching unit 310 transmits the reference level $S_{REF3}$ to the node $N_{G2}$. In one embodiment, the data driver 130 provides at least one of the reference levels $S_{REF1}$~$S_{REF3}$ to the pixel $P_{11}$ via a single data line, such as the data line $DL_1$.

In this embodiment, the reference level $S_{REF3}$ is higher than the reference level $S_{REF1}$. For example, the reference level $S_{REF3}$ is equal to 0. Additionally, the storage unit 370 stores the threshold voltage $Vth_{(M3)}$ of the transistor M3 during the period st2. Thus, the level of the node $N_{S2}$ is equal to $-Vth_{(M3)}$.

During a forward portion st3-1 of the period st3, the scan signal $SCAN_1$ is still at the high level such that the switching unit 310 transmits the signal of the data line $DL_1$ to the node $N_{G2}$. At this time, the signal of the data line $DL_1$ is a data signal $S_{DATA}$. When the level of the node $N_{G2}$ is equal to the data signal $S_{DATA}$ of the data line $DL_1$, the level of the node $N_{S2}$ is slightly increased.

During a back portion st3-2 of the period st3, the scan signal $SCAN_1$ is at a low level such that the transistor M1 is turned off. Referring to FIG. 3C, the level of the node $N_{G2}$ is equal to the data signal $S_{DATA}$ and the level of the node $N_{S2}$ is equal to $-Vth_{(M3)}+\Delta V$ during the period st3, wherein $\Delta V$ represents the change amount of the level of the node $N_{S2}$ during the period st3.

During the period st4, the transistor M3 lights the luminescence unit 350 according to the voltage difference between the nodes $N_{G2}$ and $N_{S2}$. In this embodiment, the levels of the nodes $N_{G2}$ and $N_{S2}$ are controlled to prevent the driving current $I_{D2}$ generated by the transistor M3 is interfered by the drifted threshold voltage of the transistor M3.

Figure 4:
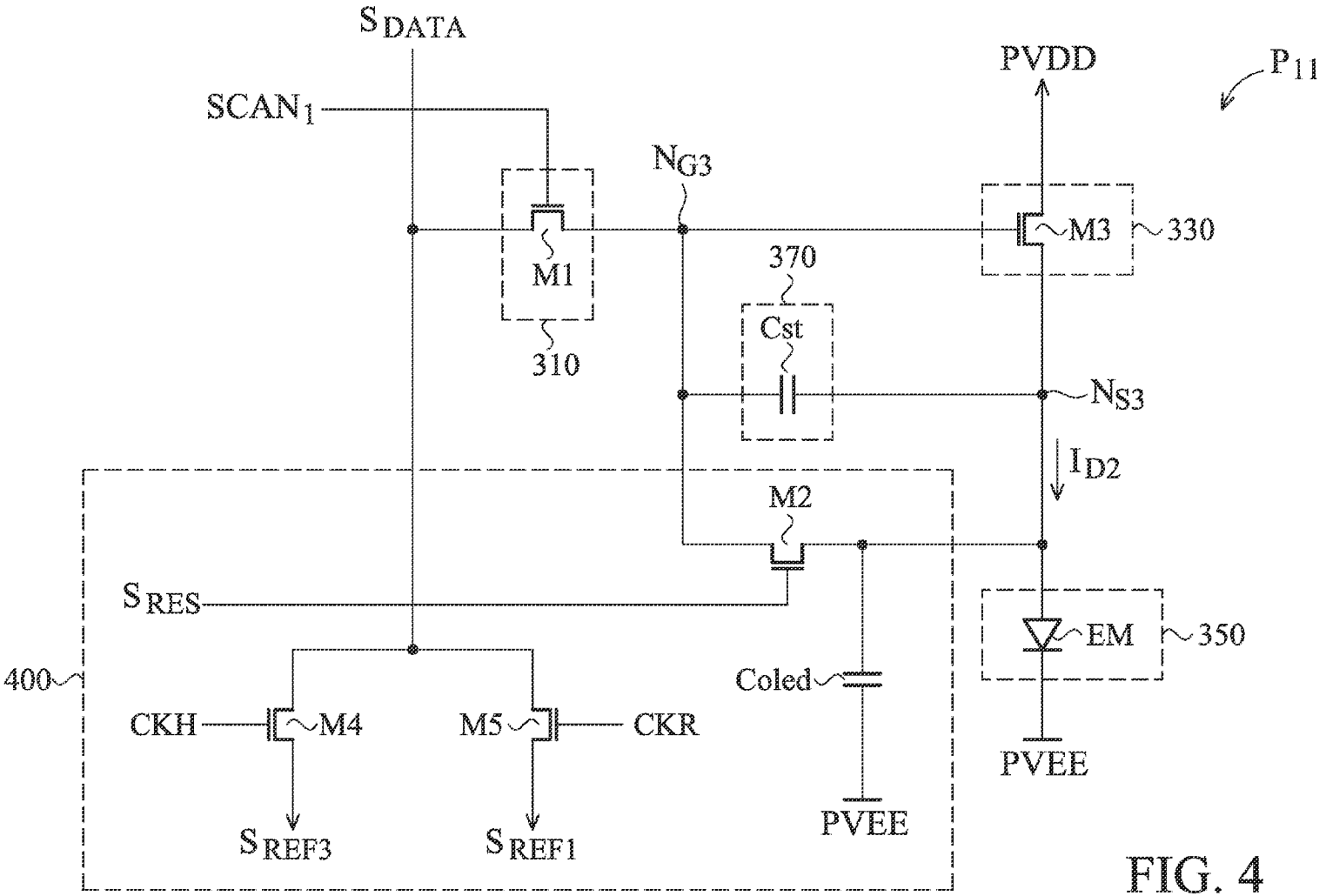
FIG. 4 is a schematic diagram of another exemplary embodiment of a pixel.

FIG. 4 is a schematic diagram of another exemplary embodiment of a pixel. FIG. 4 is similar to FIG. 3A except for the addition of a compensation capacitor Coled. In this embodiment, the compensation capacitor Coled is coupled between the node $N_{s3}$ and the operation voltage PVEE, but the disclosure is not limited thereto. In other embodiments, one terminal of the compensation capacitor Coled is coupled to the node $N_{S3}$ and another terminal of the compensation capacitor Coled receives a fixed voltage, such as the operation voltage PVDD, PVEE or other reference voltages. The compensation capacitor Coled is utilized to compensate drifted mobility of the transistor M3.

For example, if the mobility of the transistor M3 is drifted and becomes great, $\Delta V$ becomes great. Thus, the voltage difference between the nodes $N_{G3}$ and $N_{S3}$ becomes small such that the driving current generated by the transistor M3 becomes small to effect efficiency of the luminescence unit 350. In other words, a negative feedback issue is occurred in the luminescence unit 350 such that brightness of the luminescence unit 350 does not be interfered by the drifted mobility of the transistor M3.

Therefore, in this embodiment, the compensation capacitor Coled is coupled between the node $N_{S3}$ and the operation voltage PVEE to compensate the drifted mobility of the transistor M3. Further, the capacitance of the compensation capacitor Coled is adjusted to adjust the charging speed of the node $N_{S3}$ during the period st3. In other words, it prevents that $\Delta V$ becomes too great.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display system, comprising:

a scan driver providing at least one scan signal;

a data driver providing at least one data signal; and at least one pixel comprising:

a switching unit controlling a level of a first node according to the scan signal;

a driving unit having a threshold voltage and coupled to the first node;

a luminescence unit coupled to the driving unit in series between a first operation voltage and a second operation voltage;

a storage unit coupled between the first node and a second node; and a controlling unit controlling a level of the second node, wherein during a first period, the level of the first node is equal to a first reference level, and the level of the second node is equal to a second reference level, wherein during a second period, the level of the first node is equal to a third reference level, and the controlling unit makes a voltage difference between the levels of the first and the second nodes to be equal to the threshold voltage of the driving unit, wherein during a third period, the level of the first node is equal to the data signal, and wherein during a fourth period, the driving unit lights the luminescence unit according to the voltage difference between the levels of the first and the second nodes.

2. The display system as claimed in claim 1, wherein the first reference level is equal to the second reference level.

3. The display system as claimed in claim 2, wherein the first and the second reference levels are negative.

4. The display system as claimed in claim 3, wherein the third reference level is higher than the first reference level.

5. The display system as claimed in claim 1, wherein the first reference level is higher than the second reference level.

6. The display system as claimed in claim 5, wherein the second reference level is negative.

7. The display system as claimed in claim 6, wherein the first reference level is equal to the third reference level.

8. The display system as claimed in claim 1, wherein the first, the second and the third reference levels are provided from the data driver.

9. The display system as claimed in claim 1, wherein the controlling unit is a transistor comprising a control terminal receiving a reset signal, an input terminal receiving the second reference level and an output terminal coupled to the second node.

10. The display system as claimed in claim 1, wherein the controlling unit comprises:

a first transistor making the level of the first node to be equal to the level of the second node during the first period;

a second transistor providing the third reference level to the first node during the second period; and a third transistor making the level of the first node to be equal to the first reference level during the first period.

11. The display system as claimed in claim 10, wherein the controlling unit further comprises:

a compensating capacitor coupled between the second node and the second operation voltage.

* * * * *